US008535398B1

(12) United States Patent
Perlman

(10) Patent No.: US 8,535,398 B1
(45) **Date of Patent: *Sep. 17, 2013**

(54) CHEMICAL COMPLEXES COMPRISING GLYCERINE AND MONOGLYCERIDES FOR THICKENING PURPOSES

(75) Inventor: Daniel Perlman, Arlington, MA (US)

(73) Assignee: Perlman Consulting, LLC, Arlington, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/467,863

(22) Filed: May 9, 2012

(51) Int. Cl.
*C10L 1/18* (2006.01)

(52) U.S. Cl.
USPC ..... 44/388; 44/445

(58) Field of Classification Search
USPC ..... 44/308, 388, 445
See application file for complete search history.

(56) References Cited

U.S. PATENT DOCUMENTS

| | | | | |
|---|---|---|---|---|
| 2,619,493 | A * | 11/1952 | Norris | 554/148 |
| 2,838,384 | A | 6/1958 | Sloan et al. | |
| 3,779,693 | A | 12/1973 | McKenney et al. | |
| 3,801,292 | A | 4/1974 | Tanner | |
| 3,819,342 | A * | 6/1974 | Gunderman et al. | 44/275 |
| 4,012,205 | A | 3/1977 | Cohen et al. | |
| 4,156,594 | A | 5/1979 | Tarpley, Jr. | |
| 4,157,242 | A | 6/1979 | Tarpley, Jr. | |
| 4,165,968 | A | 8/1979 | Duncan | |
| 4,238,201 | A | 12/1980 | Spilles | |
| 4,365,971 | A | 12/1982 | Monick | |
| 4,786,290 | A | 11/1988 | Wyer | |
| 5,143,045 | A | 9/1992 | Minnis | |
| 5,226,405 | A | 7/1993 | Snow | |
| 5,858,031 | A | 1/1999 | Perlman | |
| 5,859,270 | A * | 1/1999 | Kolstad et al. | 554/204 |
| 6,755,877 | B2 | 6/2004 | Perlman | |
| 2011/0107947 | A1 | 5/2011 | Vernon | |

OTHER PUBLICATIONS

Aerosil Web Page, last accessed Aug. 8, 2011, at http://www.aerosil.com/product/aerosil/en/products/hydrophilic-fumed-silica/pages/default.aspx.

* cited by examiner

*Primary Examiner* — Cephia D Toomer
(74) *Attorney, Agent, or Firm* — McLane, Graf, Raulerson & Middleton, PA

(57) ABSTRACT

The present invention is generally directed to systems and methods for thickening liquids, e.g., hydrophobic liquids, non-aqueous liquids, fuels, etc. In one set of embodiments, a composition is produced by combining in a mixture, at least one monoglyceride (abbreviated "MG") and glycerine (abbreviated "G"), in which the molar ratio of G to MG in the mixture is between 1:1 and 4:1. The mixture may be melted and cooled to form solids containing a $G_2MG$ molecular complex in which two molecules of G are hydrogen-bonded to each molecule of MG. The composition may be substantially free, in certain embodiments, of contaminating reactants, catalysts, alkaline agents, and/or by-products of fatty acid interesterification that may interfere with the use of said composition as a thickening agent.

19 Claims, No Drawings

CHEMICAL COMPLEXES COMPRISING GLYCERINE AND MONOGLYCERIDES FOR THICKENING PURPOSES

FIELD OF THE INVENTION

The present invention is generally directed to systems and methods for thickening liquids, e.g., hydrophobic liquids, non-aqueous liquids, fuels, etc. Various aspects of the present invention generally relate to solid monoglyceride-containing compositions containing an agent that modifies the molecular and microscopic structure, and the dispersal properties of monoglycerides in hydrophobic liquids. Also described in certain embodiments are theologically modified hydrophobic liquids such as fuels, including hydrocarbon alkane-based odorless mineral spirits, paraffin oil and biofuels, e.g., mono-alkyl esters of medium to long chain ($C_8$-$C_{18}$) fatty acids, that have been thickened or gelled by fatty acid monoglycerides such as glyceryl monostearate and glyceryl monopalmitate, that have been modified with hydrogen-bonded glycerine.

BACKGROUND OF THE INVENTION

The following discussion is provided solely to assist the understanding of the reader, and does not constitute an admission that any of the information discussed or references cited constitute prior art.

Mineral spirits (CAS Reg. No. 64475-85-0) are petroleum distillates derived from the light distillate fractions during the crude oil refining process, and are generally composed of six to eleven carbon ($C_6$-$C_{11}$)-containing alkane hydrocarbon compounds (though small amounts of other compounds may be present), with the majority of the mass composed of $C_9$-$C_{11}$ alkanes. Mineral spirits are commonly used as a paint thinner and mild solvent. In industry, mineral spirits are used in conjunction with cutting oil, and for cleaning and degreasing machine tools and parts.

Odorless Mineral Spirits (hereinafter abbreviated "OMS"), e.g., CAS Reg. Nos. 8052-41-3 or 64742-48-9, are petroleum-derived mineral spirits that have been further refined to remove toxic aromatic compounds including benzene and toluene. OMS has an initial boiling point of about 340F (171-178° C.) and a specific mass of about 0.76 g/cc, and is often recommended for applications where humans have close contact with the solvent, including oil painting, ink printing and addition to barbecue charcoal as an easily ignited lighter fluid. As such, OMS has been used for many years to initiate combustion of more difficult to ignite regular fuels including charcoal, coal, and pellet fuels, for example. OMS charcoal lighter has dominated the marketplace and has been sold for many years by a number of companies including the Kingsford Products Company (Oakland, Calif.), Royal Oak Enterprises, LLC (Roswell, Ga.), Reckitt and Coleman (Wayne, N.J.) and Duraflame Inc. (Stockton, Calif.). User directions suggest that an amount of OMS fluid equal to approximately 10% the weight of the charcoal should be applied to the charcoal (1.6 fluid oz per pound of charcoal). Therefore, a quart of the fluid is sufficient to light approximately one 20 lb. bag of charcoal. Although used for many years, there is a significant opportunity to improve the safety and convenience of such lighter fluids by addition of an improved thickening agent.

Consideration is also given to hydrophobic non-petroleum fuels such as medium to long chain ($C_8$-$C_{18}$) fatty acid ester fuels such as biodiesel fuel. Biodiesel fuel can be used in standard diesel engines, and is thus distinct from vegetable and waste oils used to fuel converted diesel engines. Biodiesel can be used alone (termed "B100 fuel"), or blended with petroleum hydrocarbon fuels (e.g., B20 containing 20% biodiesel+80% petroleum diesel fuel). Blends of less than 20% biodiesel can be used in diesel equipment with no, or only minor, modification. Biodiesel can also be used as an alternative to petroleum-based heating oil.

Fatty acid esters contain alkyl chains of varying length, e.g., $C_4$-$C_{18}$ that may be esterified to methyl, ethyl or propyl moieties. Fatty acid methyl esters have been assigned standard CAS registration numbers based upon the number/range of carbon atoms in their fatty acids as follows: $C_6$-$C_{12}$, CAS Reg. No. 67762-39-4; $C_{10}$, CAS Reg. No. 110-42-9; $C_{12}$, CAS Reg. No. 111-82-0; $C_{12}$-$C_{18}$, CAS Reg. No. 68937-84-8; and $C_{16}$-$C_{18}$, CAS Reg. No. 85586-21-6. Fatty acid methyl esters are aliphatic organic esters primarily prepared by the reaction of carboxylic fatty acids derived from natural fats and oils and methanol in the presence of a base catalyst. The resulting esters can be subsequently processed into various alkyl range cuts by fractional distillation. Fatty acid methyl esters are used extensively as intermediates in the manufacture of detergents, emulsifiers, wetting agents, stabilizers, textile treatments, and waxes, among other applications. Lesser volumes of fatty acid methyl esters are used in a variety of direct and indirect food additive applications, including the dehydration of grapes to produce raisins, synthetic flavoring agents, and in metal lubricants for metallic articles intended for food contact use. Fatty acid methyl esters are also used as intermediates in the manufacture of a variety of food ingredients.

Applicant's co-pending U.S. patent application Ser. No. 13/205,026, incorporated herein by reference, employs, in some embodiments, thermo-precipitated monoglycerides as rheology modifiers that thicken hydrophobic liquid fuels. When certain monoglycerides are thermo-precipitated and dispersed under suitable conditions in a hydrophobic liquid such as a petroleum-based fuel, these monoglycerides are capable of forming micron-sized solid microparticles that can thicken the liquid. The compositions and methods therein describe, in certain embodiments, the use of molten monoglycerides that are added and dispersed at an elevated temperature, e.g., 70-80° C., into a flammable fuel.

In the present invention, certain embodiments are directed to reducing the hazard associated with dispersing an ingredient in a flammable hydrophobic liquid, e.g., so that neither the ingredient nor the liquid are at a temperature above the flash point of the liquid. Applicant has devised various compositions herein, including compositions that allow dispersal of solid monoglycerides at ambient temperature in a flammable fuel in which the chemistry and the physical structure of the monoglycerides have been altered to allow such dispersal and thickening of a fuel at ambient temperature.

SUMMARY

Monoglycerides (abbreviated "MG") whose molecules have been commingled and/or chemically complexed with glycerine are used in certain embodiments of the invention for thickening hydrophobic liquids such as liquid fuels. Without wishing to be bound by any theory, it has been empirically determined that two glycerine molecules can be complexed with an MG molecule by an associative hydrogen-bonding mechanism. This hydrogen bonding of glycerine (abbreviated "G") to MG is especially effective in disrupting the continuous waxy structure of unmodified MG solids that prevents the solids from being dispersed directly into many hydrophobic liquids such as mineral spirits to thicken these liquids.

MG molecules (also known as monoacylglycerols) are formed from one fatty acid molecule covalently bonded to a three carbon glycerol backbone via an ester linkage. Depending on whether the ester-linked fatty acid occupies the middle or the end position on the glycerol backbone, the MG is either a 2-monoacylglycerol or a 1-monoacylglycerol. Monoacylglycerols may be produced by either chemical synthesis or by an enzymatic process. Enzymatic treatment of triglyceride (fat) and diglyceride molecules by pancreatic lipase for example, yields 2-monoglycerides. Synthetic interesterification that combines triglycerides with an excess of free glycerine in the presence of NaOH typically yields a largely random distribution of fatty acid ester locations on the glycerol backbone. The reaction also may yield a mixture of MGs combined with reactants, catalysts and undesirable by-products in some cases that must be removed before the MGs can be used in commercial applications. It is common for MGs to be fractionated and purified by vacuum distillation. MGs can be synthetically produced from either animal or vegetable-derived fats. Thus, saturated fats or fully hydrogenated fats (e.g., palm oil, palm kernel oil, tallow, lard, or fully hydrogenated varieties thereof) are commonly interesterified with glycerine, and the resulting MGs also may be predominantly saturated. Such saturated fatty acid MGs may be abbreviated "SFA-MGs." They contain predominantly 12, 14, 16 and 18 carbon ester-linked fatty acids and have melting points ranging between approximately 50° C. and 68° C. For example, a useful purified SFA-MG combination of glyceryl monostearate and glyceryl monopalmitate with a melting point of approximately 66° C. can be produced by interesterifying fully hydrogenated palm oil with glycerine, and subsequently purifying and distilling the MGs to eliminate both non-reacted reactants and by-products (including fat, glycerine, sodium hydroxide, diglycerides and other by-products).

MGs, and in particular those containing saturated fatty acids with twelve to eighteen carbon atoms, are waxy solids typically added to edible oils in small quantities by heating the glycerides alone or combined with an edible oil to a temperature above the melting point, e.g., 60° C. or above, prior to mixing with other ingredients. MG and diglyceride molecules are generally amphiphilic in character, containing both hydrophobic and hydrophilic portions. They typically serve as emulsifiers to help stabilize a variety of mixtures of dissimilar ingredients that are often liquid or semi-liquid. For example, a combination of MG, edible fats and oils, water and flavorings that would otherwise not mix, can be combined to form buttery table spreads. MGs are found in a wide variety of food products including bakery products, beverages, ice cream, shortenings, margarines, confections, and whipped toppings, for example. In the case of a margarine emulsion, a melted MG may be blended with oil and water to produce stable micelles that contain microdroplets of water and other ingredients that are surrounded by a continuous oil phase. The stabilizing emulsifier molecules tend to concentrate at the interface between the suspended water droplets and the surrounding oil.

In some embodiments, MG compositions and methods have been discovered whereby a solid material can be produced composed of micron-sized MG microparticles in which glycerine molecules have been hydrogen-bonded to MG molecules in a substantially water-free mixture to form a new chemical complex. In some cases, the glycerine molecules and/or the MG molecules may be purified. These microparticulate solids may be stable and can be produced ahead of time for later use. The complex may be produced by heating and melting together certain proportions of purified glycerine and MG in the substantial absence of water, and subsequently cooling the melt to room temperature. The resulting solid material composed of microparticles may be stored at room temperature for an extended time, and some time thereafter may be dispersed at room temperature in a fuel or other hydrophobic liquid.

The MG compositions and methods described herein incorporating glycerine may offer advantages over methods that require dispersal of molten MG at elevated temperature into a flammable fuel using high shear dispersal equipment. Simply stated, a purified MG may be combined in suitable proportions with glycerine, and hydrogen bonded at the molecular level, converting the physical structure of the MG from an amorphous waxy solid to a microparticulate solid that is readily dispersible in a hydrophobic liquid.

Various aspects of the present invention provide, inter alia, advantageously supplemented hydrophobic fuels that are thickened by addition of a novel agent comprising or consisting essentially of glycerine-modified SFA-MGs. The SFA-MG ingredient typically contains $C_{12:0}$, $C_{14:0}$, $C_{16:0}$, and/or $C_{18:0}$ fatty acids. In some cases, the SFA-MG may be purified. The SFA-MGs may be heated, melted, and combined with a suitable and sufficient proportion of glycerine (e.g., 2 parts by weight mixed $C_{16:0}$ and $C_{18:0}$ MGs to 1 part by weight glycerine), e.g., in a substantially water-free mixture. The melted and/or commingled mixture of glycerine and monoglyceride may be cooled to form a solid that, surprisingly, has a microparticulate structure that facilitates dispersal, rather than the characteristic amorphous waxy structure of MGs. The glycerine-modified MG microparticulate solids are remarkably stable in some embodiments; for example, the MG microparticulate solids may be readily dispersible at room temperature in OMS petroleum lighter fluid and other hydrophobic liquids, whereas the same MG lacking glycerine is not dispersible at room temperature. The microparticulate-thickened OMS fuel compositions are, for example, useful for lighting charcoal fires, such as in charcoal grills.

One aspect of the invention provides a fuel composition that includes at least one hydrophobic liquid and an effective amount of at least one SFA-MG agent combined with a suitable amount of glycerine. With appropriate conditions of shear-blending, for example, the combined glycerine-MG agent dispersed in the hydrophobic liquid may cause effective thickening of the fuel composition, using, for example, as little as 2%-4% by weight MG combined with 1%-2% glycerine.

In certain embodiments, the MG material may be heated, melted and combined with glycerine, e.g., in a substantially water-free mixture (which may in some cases facilitate hydrogen-bonding between the MG and the glycerine), before being cooled to form a solid, e.g., as a microparticulate agent; the liquid being supplemented with the microparticulate agent may be a hydrocarbon- or fatty acid ester-based hydrophobic liquid, and/or the hydrophobic liquid may be combustible; the MG agent may contain predominantly SFA-MGs; the MG agent may contain predominantly SFA-MGs and may not contain a significant level of fatty acid di- or tri-glycerides; the MG agent may contain a combination of SFA-MGs and disaturated fatty acid diglycerides; the MG agent may contain a combination of SFA-MGs and disaturated fatty acid triglycerides; and/or the MG agent may contain a combination of SFA-MGs, disaturated fatty acid diglycerides, and trisaturated fatty acid triglycerides.

In particular embodiments, for any of the agents described above or otherwise described herein, the composition includes glycerine (G) molecules commingled and/or hydrogen-bonded with MG molecules in ratios by weight of G:MG of between 1:1 to 1:1.5, 1:1.5 to 1:2.0, 1:2.0 to 1:2.5, 1:2.5 to 1:3.0, 1:3.0 to 1:3.5, and 1:3.5 to 1:4.0, and/or any combinations thereof (e.g., 1:1 to 1:4). The MG ingredient typically contains either $C_{10:0}$, or $C_{12:0}$, or $C_{14:0}$, or $C_{16:0}$, or $C_{18:0}$ fatty acids or any combination thereof.

In particular embodiments, for any of the agents described above or otherwise described herein, the hydrophobic liquid composition containing the composite G+MG agent may include 1-15%, 2-15%, 3-15%, 5-15%, 1-12%, 2-12%, 3-12%, 4-12%, 5-12%, 7-12%, 1-10%, 2-10%, 3-10%, 4-10%, 2-8%, 2-6%, 3-8%, 3-6%, 3-5%, 4-8%, or 4-6% by weight of the agent; the combustible hydrophobic liquid may be or include an aliphatic hydrocarbon liquid, for example, an alkane hydrocarbon liquid, odorless mineral spirits, or paraffin oils; the hydrophobic liquid may be or include an fatty acid alkyl ester hydrophobic liquid, for example, a fatty acid mono-alkyl ester liquid such as a liquid in which some, most, or substantially all of the fatty acid esters (e.g., at least 40%, at least 50%, at least 60%, at least 70%, at least 80%, or at least 90% of the fatty acid molecular moieties) are fatty acid mono-methyl esters, fatty acid mono-ethyl esters, and/or fatty acid mono-propyl esters, or a combination thereof, where in certain beneficial cases some, most, or substantially all (e.g., at least 40%, at least 50%, at least 60%, at least 70%, at least 80%, or at least 90% of the fatty acid molecular moieties contain 18 or fewer, 16 or fewer, 14 or fewer, or 12 or fewer carbon atoms. In certain cases, at least 40%, at least 50%, at least 60%, at least 70%, at least 80%, or at least 90% by weight of the MG agent may be glycerol monostearate or glyceryl monopalmitate or a mixture of glyceryl monostearate and glyceryl monopalmitate. In addition, other MG agents may be present in addition and/or instead of glycerol monostearate or glyceryl monopalmitate.

In particular embodiments, the glycerine-containing composite MG agent also may contain at least one saturated fatty acid-containing diglyceride, e.g., glyceryl distearate, glyceryl dipalmitate, glyceryl palmitostearate and/or combinations thereof; the agent also may contain a fat that is solid at room temperature, for instance, containing trisaturated triglycerides, e.g., tristearin, tripalmitin, palmitodistearin, stearodipalmitin, and/or combinations thereof; and/or the agent also may contain at least one saturated fatty acid-containing diglyceride (e.g., as just listed above) and/or at least one trisaturated triglyceride (e.g., as just listed above).

In particular embodiments, the glycerine-containing composite MG agent may be supplemented with a limited amount (between 5% and 50% by weight) of at least one hydrophobic liquid that is soluble in the remainder of hydrophobic liquid being thickened. This supplementation with a hydrophobic liquid typically acts to accelerate the disintegration and dispersal of the solid composite MG agent in the bulk of the hydrophobic liquid being thickened. By way of example, a limited amount of light mineral oil, e.g., 25% by weight, that is miscible in a chemically similar (but lower molecular weight) OMS fuel being thickened, can be combined with 75% by weight of the glycerine-containing composite MG thickening agent to accelerate dispersal of the thickener in the OMS fuel.

Another aspect of the invention provides a method of thickening a hydrophobic fuel, a combustible fuel, and/or a liquid fuel. The method involves, in some cases, combining a solution containing a hydrophobic liquid with an effective amount of at least one solid glycerine-modified MG microparticulate agent and shear-dispersing the agent until the microparticulate agent (including molecules of glycerine-modified MG released from the microparticulate agent) is homogeneously dispersed therein, thereby forming a thickened or gelled fuel. In some cases, the hydrophobic liquid may be a hydrophobic liquid fuel.

In certain embodiments, the glycerine-MG composite agent may be dispersed in the hydrophobic liquid at ambient temperature; the glycerine-MG composite agent may be dispersed in the hydrophobic liquid under conditions of temperature, moderate or high shear mixing, and the physical form of the solid composite agent that the agent is fully dispersed as microparticles in the liquid within 5 seconds, 10 seconds, 15 seconds, 20 seconds, 30 seconds, or 60 seconds, or with 2 minutes, 3 minutes, or 5 minutes of combining the agent and the liquid; the glycerine-MG composite agent may be added to the hydrophobic liquid in the form of a solid; the MG agent may be added to the hydrophobic liquid as a broken solid (the use of small particles, e.g., flakes, small irregular chunks, or solidified droplets may be beneficial to reduce dissolution time, in some embodiments); immediately before rapid mixing of the hydrophobic liquid with the glycerine-MG composite agent, the temperature may be at least 1° C., 2° C., 3° C., 4° C., 5° C., 8° C., or 10° C. or is in a range of 1-10° C., 1-5° C., 2-10° C., 2-7° C., 5-10° C., or 5-15° C. below the melting temperature of the composite agent in the hydrophobic liquid; immediately before the rapid mixing of the hydrophobic liquid with the glycerine-MG composite agent, the temperature may be at least 10° C., 15° C., 20° C., 25° C., 35° C., or 40° C. or is in a range of 10-20° C., 15-25° C., 20-30° C., 25-35° C. or 30-40° C.; and/or the glycerine-MG composite agent may be added to the hydrophobic liquid at a temperature at least 10° C., 7° C., 5° C., 4° C., 3° C., 2° C., or 1° C. below the solvent-free melting temperature of the glycerine-MG composite agent. The hydrophobic liquid may be a hydrophobic liquid fuel in certain cases.

In another set of embodiments, a hydrophobic liquid may be mixed with glycerine molecules and MG, e.g., to form a ternary mixture or a solid. In some cases, the hydrophobic liquid may be a non-aqueous, and/or a fuel, e.g., a hydrophobic fuel, a combustible fuel, and/or a liquid fuel. For example, the hydrophobic liquid in the mixture or solid may be substantially similar or even identical to one which the mixture or solid is targeted, e.g., for thickening purposes. Without wishing to be bound by any theory, it is believed that some of the hydrophobic liquid may be useful to facilitate dispersion in the target liquid, e.g., due to chemical similarity (or chemical identity). The hydrophobic liquid may be present in any suitable quantity in the mixture or solid. For instance, the hydrophobic liquid may be present at less than about 50%, less than about 40%, less than about 30%, less than about 20%, or less than about 10% by weight. In one embodiment, the hydrophobic liquid is present between about 10% and about 50%.

In some beneficial embodiments, the method includes rapidly mixing a first quantity of the glycerine-MG composite agent dispersed in a first hydrophobic liquid, with a second volume of a second hydrophobic liquid, thereby forming a mixed hydrophobic liquid. The first and second liquids may be the same or different. The temperature of the mixed hydrophobic liquid may be below the solvent-free melting temperature of the glycerine-MG composite agent, the first volume may be less than the second volume, e.g., no more than 0.01, 0.02, 0.05, 0.07, 0.10, 0.15, 0.20, 0.25, 0.30, or 0.40 times the second volume. The first hydrophobic liquid may be a hydrophobic liquid fuel, and/or the second hydrophobic liquid may be a hydrophobic liquid fuel.

In particular embodiments, from 1 to 49 parts by weight of the first hydrophobic liquid containing a dispersed microparticulate glycerine-MG composite agent at a temperature below the melting temperature of the composite agent in the first hydrophobic liquid may be mixed with from 51 to 99 parts by weight of the second hydrophobic liquid, thereby forming 100 parts by weight of the mixed hydrophobic liquid containing from 1 to 10 parts by weight of the dispersed microparticulate agent at a temperature below the melting temperature of the agent in the mixed hydrophobic liquid; and/or from 2 to 25 parts by weight of the first hydrophobic liquid containing the dispersed microparticulate agent at a temperature below the melting temperature of the agent in the first hydrophobic liquid may be mixed with from 75 to 98 parts by weight of the second hydrophobic liquid, thereby forming 100 parts by weight of the mixed hydrophobic liquid containing from 2 to 5 parts by weight of the dispersed microparticulate agent at a temperature below the melting temperature of the agent in the mixed hydrophobic liquid. The first hydrophobic liquid may be a hydrophobic liquid fuel, and/or the second hydrophobic liquid may be a hydrophobic liquid fuel.

In certain embodiments, the dispersed microparticulate agent may be or include glyceryl monostearate, glyceryl monopalmitate, or both combined with glycerine (e.g., melted together, mixed and cooled); the dispersed microparticulate agent may contain MG (e.g., as just listed) and also may in some cases contain at least one saturated fatty acid-containing diglyceride (e.g., glyceryl distearate, glyceryl dipalmitate, glyceryl palmitostearate and combinations thereof) and/or the agent also may contain a fat that is solid at room temperature containing trisaturated triglycerides (e.g., tristearin, tripalmitin, palmitodistearin, stearodipalmitin, and combinations thereof); the fuel may be a hydrocarbon-based liquid fuel, an alkyl ester-based liquid fuel or a combination thereof; the alkyl ester-based liquid fuel may be a fatty acid mono-alkyl ester-based liquid fuel and the agent also may include in some cases at least one trisaturated triglyceride component, e.g., containing stearic or palmitic fatty acids or both. Other components may also be present in addition to the ones described above in certain embodiments of the invention.

Another aspect provides a method of lighting barbecue charcoal (e.g., shaped charcoal briquettes or irregular lump charcoal). In some embodiments, the method involves applying an effective amount of a thickened or unthickened fuel composition to a first layer of the barbecue charcoal, adding a second layer of the barbecue charcoal on top of the first layer, and igniting the fuel composition on the first layer.

In certain embodiments, the quantity of charcoal in the first and second layers together may be at least 1 pound, 2 pounds, 3 pounds, 4 pounds, or 5 pounds of charcoal or 1-3 pounds or 2-4 pounds; and/or the effective amount of fuel composition may be 1 to 10 fluid ounces, 1 to 8 fluid ounces, 1 to 6 fluid ounces, 1 to 5 fluid ounces, 2 to 10 fluid ounces, 2 to 8 fluid ounces, 2 to 6 fluid ounces, 3 to 10 fluid ounces, 3 to 8 fluid ounces, or 4 to 10 fluid ounces.

In some cases, the charcoal may rest on a non-combustible support such as a grate or support platform (which may be perforated or otherwise include air passage through the support, for example, in a barbecue grill, hibachi, or similar device); the weight amount of the fuel composition which is applied may be approximately 0.05 to 0.15, 0.05 to 0.10, or 0.10 to 0.15 times the weight of the charcoal in certain embodiments.

Additional embodiments will be apparent from the Detailed Description and from the claims.

In co-pending U.S. patent application Ser. No. 13/205,026 entitled "Fuel Compositions and Fuel Thickeners, Including Monoglycerides" incorporated herein in its entirety by reference, Applicant describes, in one embodiment, a fuel composition that contains at least one hydrophobic liquid fuel and an effective amount of at least one saturated fatty acid MG agent (abbreviated "SFA-MG"), in which the heat-solubilized MG agent is rapidly and substantially diluted into a much cooler liquid fuel, causing precipitation of the MG as microparticles in the liquid fuel, and thereby causing thickening. The hydrophobic liquid fuel may be a hydrocarbon fuel such as aliphatic odorless mineral spirits or paraffin oil, or the fuel is a fatty acid alkyl ester-based fuel such as a $C_{18}$, $C_{16}$ or a $C_{10}$ and $C_8$ fatty acid methyl ester-based fuel. The fuel may contain between 2% and 6% by weight of at least one SFA-MG agent such as glyceryl monostearate and/or glyceryl monopalmitate. The fuel may also contain between 1% and 10% by weight of at least one saturated fatty acid-containing diglyceride in some cases. Other methods are also described, e.g., allowing a dissolved (e.g., heat-solubilized) MG agent to be precipitated (e.g., rapidly precipitated) as microparticles in a larger volume of cool hydrophobic liquid fuel to cause its thickening.

Applicant has observed that effective thickening of hydrophobic liquid fuels may depend upon MG precipitation as microparticles. However, some processes for precipitation involve heating of ingredients, specialized equipment to achieve rapid mixing of flammable fuel, and/or introducing a heated ingredient into a flammable fuel in which the temperature of the added ingredient may be often above the flash point of the fuel. Accordingly, there are a number of technical and safety issues that require attention in implementing this process for thickening a hydrophobic fuel.

No prior art has been found that describes the spontaneous formation of micron-sized microparticles by combining and hydrogen-bonding a sufficient molar ratio of glycerine with MG material in a heated and melted mixture that is substantially free of water, e.g., 2 moles of glycerine to 1 mole of MG material, e.g., glyceryl monostearate and/or glyceryl monopalmitate. In some cases, the MG material may be purified. The MG material may be melted, mixed, and/or molecularly commingled with glycerine, which may allow hydrogen bond formation between the glycerine hydroxyl groups and the two hydroxyl moieties present in the MG molecule. It is important, in some embodiments of the invention, that substances including water and/or other substances present during interesterification reactions involving fatty acids and glycerides that can interfere with the presently described hydrogen bond formation between glycerine and MG must be substantially excluded from the mixture.

As described herein, glycerine, G, and MG are combined, in accordance with certain embodiments of the invention, in a mixture such that the weight ratio of G to MG is between approximately 1:1 and 1:4, such as approximately 1:2. In some cases, G and MG may be combined in a mixture such that the molar ratio of G to MG is between approximately 1:1 and approximately 4:1. The mixture may be heated to a temperature above the melting point of the MG, mixed to allow the molecules to commingle, and subsequently allowed to cool. The mixture may spontaneously solidify as a mass of micron sized solid microparticles containing an associative chemical complex of hydrogen-bonded G and MG. For example, based upon direct microscopic observations, 2.0 parts by weight of purified MG material of glyceryl monostearate and glyceryl monopalmitate (solidified as microparticles) are able to sequester up to 1.0 part by weight glycerine. This weight ratio corresponds to a molar or molecular ratio of about two molecules of G per one molecule of MG. When more than the aforesaid 1.0 part by weight glycerine is combined with 2.0 parts by weight of heat-melted MG, a microscopic examination of the cooled, solidified mixture shows microdroplets of free glycerine scattered throughout the field of MG microparticles. In other words, without wishing to be bound by any theory, the full capacity of MG microparticles to bind (i.e., hydrogen-bond) G is believed to correspond to each MG molecule with its two free hydroxyl groups hydrogen-bonding two molecules of G. It is believed that this G-MG hydrogen-bonding may also be instrumental in disrupting the normal solidification of MG as a continuous waxy solid. Rather, the G-MG complex may solidify as a mass of micron-sized microparticles that are readily dispersed at ambient and even cool temperatures (well below flash point temperatures for safety) in hydrophobic liquids such as mineral spirits-based fuels and fatty acid methyl ester fuels with shear-agitation, in accordance with certain embodiments of the invention.

Molar ratios may be useful in some cases in demonstrating chemical stoichiometry and complex formation. For example, the molar ratio of G/MG provides the number of glycerine (G) molecules that can hydrogen-bond with a monoglyceride (MG) molecule. Weight ratios may be used in some cases to provide directly measurable quantities of material for formulation purposes. For the most common commercial MGs that contain $C_{16}$ and $C_{18}$ fatty acids, the MG average molecular weight is about 350 daltons, while the molecular weight of G is only 92 daltons. Thus, a 1:1 molar ratio of G to MG would equal a G/MG weight ratio of 92/350 or 1/3.8.

Thus, certain embodiments of the present invention provide a simplified and safer process for thickening a flammable hydrophobic fuel employing MGs. In these embodiments, the fuel is neither heated, nor is the fuel combined with a hot ingredient. The new process is based on Applicant's initial discovery that 2 parts by weight of a typical SFA-MG produced from fully hydrogenated palm oil containing 16 and 18 carbon fatty acids (palmitate and stearate MGs) could be converted into "microparticulate solids" by melting and mixing these MGs with a suitable proportion, i.e., approximately 1 part by weight of glycerine. When cooled, this hydrogen-bonded glycerine-modified MG material (2:1 weight ratio or 1:2 molar ratio of MG:G) can be conveniently introduced at room temperature into an OMS fuel in some embodiments, for example, using shear-dispersal. Amorphous microparticles, some of which are less than one micron in diameter, may contain the glycerine-MG complex, and may be visible in some embodiments by phase contrast microscopy of the fuel. For example, on a microscope slide, 3%-4% by weight of these microparticles suspended in OMS fuel can be seen to move in a thixotropic (shear-thinning) manner, forming a visible and substantially static network of particles that acts to thicken the fuel as liquid movement slows.

In one embodiment of the present invention, compositions and methods are described herein for producing and using microparticulate MGs as a thickening agent for hydrophobic liquids such as OMS. Applicant has discovered that a useful thickening ingredient is produced when a suitable amount of glycerine (abbreviated "G" herein) is mixed and its molecules commingled with a certain amount of heated and melted MG. For example, one part by weight glycerine combined with 2 parts by weight MG corresponds to a ratio of approximately 2 molecules glycerine per molecule of MG. The commingling of G and MG in this 1:2 ratio is believed to produce a hydrogen-bonded chemical complex in which little or no free glycerine can be seen microscopically using cross-polarized light, as two molecules of G appear to bond with each molecule of MG to produce uniformly sized microparticles of $G_2MG$. Further addition of G may result in visible glycerine microdroplets that do not bind or become integrated into MG microparticles. The choice of MG is usually selected to have a melting point that is substantially elevated above room temperature (e.g., above 50° C. or 60° C.), and as such is usually a saturated fatty acid MG such as glyceryl monostearate and/or monopalmitate.

When mixed, melted and subsequently cooled and solidified, the re-solidified G+MG mixture has the unusual property of solidifying as a microparticulate mass of material. This material, which may be formed, or consist essentially of hydrogen-bonded glycerine (G) and MG molecules in some cases, can be added and dispersed at ambient temperature into a flammable liquid fuel to produce a fuel that is thickened with G-MG-containing microparticles, in accordance with certain embodiments of the present invention. For example, when shear-blended in a petroleum fuel such as odorless mineral spirits fuel at levels of approximately 1%-10% by weight solids, the material may disperse as single microparticles and small groups of microparticles. The weight proportions of G and MG that are combined to form a microparticulate G-MG complex may be varied depending upon the choice of MG. For example, a weight ratio of approximately one part G to 2 parts MG is generally useful for MG derived from a fully hydrogenated palm oil that yields predominantly glyceryl monostearate and glyceryl monopalmitate. If excess glycerine is blended into the melt (e.g., 1 part G+1 part MG), the resulting product examined using polarized light microscopy shows excess free glycerine microdroplets distributed among a continuous visual field of G-MG microparticles. On the other hand, when only 1 part G is blended with 3-4 parts of the same MG, the resulting G-MG material viewed using polarized light microscopy appears waxy and continuous rather than microparticulate, and is more difficult to disperse in OMS, for example. In various embodiments of the invention, the weight ratio of G to MG may be about 5:1, about 4:1, about 3:1, about 2:1, about 1:1, about 1:2, about 1:3, about 1:4, or about 1:5. In some cases, the weight ratio of G to MG may be between about 1:1 and about 1:5, between about 1:1 and about 1:4, or between about 1:1 and about 1:3.

Several embodiments of the present invention are generally directed to compositions and methods for improving the dispersal of MGs. Although not bound by any theory, it is believed, based on Applicant's research, that the glycerine functions neither as a solvent nor as an emulsifier for the MG, but rather as a hydrogen-bonding complex-forming agent that may act as a disruptive "spacer molecule" between neighboring MG molecules. Regardless of the actual mechanism, the presence of glycerine may alter the association among groups of MG molecules. This alteration is evidenced, for example, by the transformation of a typically waxy MG material (that solidifies as a wrinkled and cracked sheet on a microscope slide) to a microparticulate material in which most of the particles have diameters of less than 5 microns. Based on different lines of evidence, and without wishing to be bound by any theory, it is believed that, when heated together in a substantially water-free mixture, two glycerine molecules can associate and form hydrogen bonds with the two hydroxyl moieties in each MG molecule. This bonding appears to disrupt the continuous waxy structure of a purified MG and convert the MG to a microparticulate material.

Thus, in one set of embodiments, the present invention is generally directed to a mixture of glycine and at least one MG having a molar ratio of between approximately 1:1 and approximately 10:1, between approximately 1:1 and approximately 7:1, between approximately 1:1 and approximately 6:1, between approximately 1:1 and approximately 5:1, between approximately 1:1 and approximately 4:1, or between approximately 2:1 and approximately 4:1. In some cases, the molar ratio may be about 1:5, about 1:4, about 1:3, about 1:2, about 1:1, about 2:1, about 3:1, about 4:1, or about 5:1.

As described herein, glycerine, a three carbon and three hydroxyl group-containing polar substance, may beneficially be combined (e.g., at the molecular level) with MG to form a binary or ternary complex for example, by heating, melting, mixing and finally cooling in a substantially water-free blend, approximately:

(a) two parts by weight of at least one MG agent and (b) one part by weight glycerine (abbreviated "G").

The very small average diameter of the microparticles formed with MGs and glycerine may allow these microparticles to remain dispersed in some cases in hydrophobic liquids, e.g., almost indefinitely without settling. The use of a MG and glycerine in forming a complex may provide a significant advantage over the use of MG alone. A useful MG+glycerine complex may be formulated by heating and melting together approximately 2 parts by weight of a MG such as Myverol 18-04 (manufactured by Kerry Ingredients and Flavours, Beloit, Wis.) with 1 part by weight glycerine. The MG emulsifier, e.g., Myverol 18-04 may contain glyceryl monostearate and/or glyceryl monopalmitate. Formulations containing higher or lower proportions of glycerine and emulsifier may also be constituted in some embodiments of the invention.

Further details regarding glycerine biochemistry: Glycerine (aka, glycerol, or glycerin, $C_3H_8O_3$) is a relatively low molecular weight (MW of 92) water-soluble, polar liquid with low vapor pressure. It is a colorless, odorless, edible, sweet-tasting hygroscopic liquid that is widely used in pharmaceutical preparations. Its three hydroxyl groups are responsible for its water-miscibility and hygroscopic nature. Glycerine is a precursor for synthesis of triglycerides and of phospholipids in the liver and adipose tissue.

MG has an average molecular weight of ~350. When the 1.0/2.0=0.50 weight ratio of G/MG is compared to the ratio of their molecular weights (92/350=0.26), the two moles of glycerine could form a single physical phase with one mole of MG. This stoichiometry suggests that a hydrogen-bonding association may occur between two glycerine molecules and the two free —OH moieties present in each MG molecule. Without wishing to be bound by any theory, it is believed that the hydrogen-bonding association differs from chemical solubility in which a solute and solvent are not constrained by the formation of such a complex.

The MGs that solidified following cooling of the above-described melted mixtures of MGs prepared with glycerine were compared by phase contrast light microscopy and polarizing light microscopy. The glycerine-associated MGs solidified as masses of countless microscopic spherules (also known as "microspheres") each measuring less than 5 microns, many measuring approximately 2-4 microns, and many others measuring approximately 1-2 microns or less in diameter. The microspheres appeared amorphous under non-polarized light, phase contrast illumination.

DETAILED DESCRIPTION

Various compositions and methods described herein allow the thickening and/or gelling of fuel compositions comprising hydrophobic liquids, such as hydrophobic liquid fuels. This may be achieved in some embodiments using cost-effective and/or environmentally sustainable agents for this purpose. Among other applications, thickened fuel compositions may be used to initiate the combustion of solid fuels that are more difficult to ignite, including but not limited to charcoal and irregular lump charcoal. The fuel composition may include a hydrophobic liquid in some cases. The hydrophobic liquids may comprise fuels, which include, but are not limited to, hydrocarbon fuels such as alkane-based odorless mineral spirits, paraffin oil or mineral oil, and ester-type biofuels such as mono-alkyl esters of long chain fatty acids of animal or vegetable origin (also known as biodiesel fuels). The description below emphasizes, for explanatory purposes, the use and thickening of watery thin hydrocarbon-based "lighter fluid" (also known as Odorless Mineral Spirits, abbreviated "OMS"), but is not limited to that material.

From years of experience lighting barbecue charcoal and wood fires using OMS, Applicant believes that OMS can be improved by thickening the OMS fluid to achieve one or more of the following:

(a) reducing contamination of the hands and the outside of the storage container by OMS liquid;

(b) allowing more uniform application of OMS onto briquettes and irregular lumps of charcoal owing to the visibility of the thickened white coating;

(c) reducing the absorption of OMS into the charcoal allowing easier ignition of surface fuel for a longer time interval following application, and earlier volatilization of undesirable OMS odors from ignited charcoal; and (d) more efficient ignition of briquettes allowing less fluid to be used per fire.

Typical current directions for use of an OMS lighter fluid call for a generous amount of the fluid to be applied to the charcoal (e.g., 1.6 oz fluid per 16 oz charcoal). Traditional lighter fluid is nearly instantly absorbed, and unless a large amount of the fluid is applied, either the charcoal is difficult to ignite or the fire burns too briefly to ignite the charcoal. By substantially saturating the charcoal with OMS, the fire is more easily ignited and the fuel burns long enough to ignite the charcoal. However, the use of so much OMS (10% by weight of the charcoal) may be considered wasteful, and the charcoal typically continues to emit mineral spirits fuel odors even after grilling of food has commenced. Moreover, much of the heat generated from combustion of the fluid rises away from the charcoal rather than rising into the charcoal to initiate its combustion. The present invention facilitates, in one set of embodiments, various techniques for overcoming these difficulties.

Applicant has now discovered that OMS lighter fluid (as well as other suitable hydrophobic liquids, such as hydrophobic liquid fuels, for example, mineral oil) can beneficially be thickened, in accordance with one set of embodiments, by dispersing a remarkably small proportion (e.g., 2%, 3%, or 4% by weight) of an agent comprising one or more SFA-MGs that have been pre-combined by melting and/or commingling SFA-MGs, i.e., molecules thereof, with a suitable amount of glycerine molecules. This process allows the SFA-MG and glycerine molecules to form hydrogen bonds in which up to two glycerine molecules can bond with each MG molecule. The resulting $G_2MG$ molecular complex forms stable microparticulate solids upon cooling and solidifying. The microparticulate solids are partially or fully dispersible in an OMS lighter fluid (and/or other suitable hydrophobic liquid), and when added at a sufficient level (e.g., 1%-10% by weight) and shear-blended in the liquid, useful thickening of the liquid occurs. Thus, for example, 2 parts by weight of MG and 1 part by weight glycerine can be melted together, cooled, solidified, and dispersed by shear-blending with OMS fluid (or other hydrophobic liquid) at ambient temperature to cause thickening of the liquid. In many cases, most thickening occurs rapidly within seconds or minutes. In other cases, depending on the liquid selected, the MG selected, and the ambient temperature, thickening may increase over a matter of hours or over the course of a day or two before reaching maximum thickening.

In one set of embodiments, the hydrophobic liquid may be a fuel. The hydrophobic liquid may also be a hydrocarbon-containing liquid in certain embodiments, for example, OMS, or paraffin oil or mineral oil, available commercially in both light and heavy grades. Typically, the fuel is combustible, i.e., the fuel is susceptible to combustion or reaction with oxygen in the air, and often will burn in an open flame when ignited and exposed to the air (i.e., the fuel may be flammable in some cases). In some embodiments, upon contact with a flame from a match (or other ignition source) under ambient conditions, e.g., at room temperature (25° C.) and normal atmospheric pressure (1 atm), a fuel may be ignited. In contrast, some materials, such as cooking oil, will not ignite under ambient temperature and pressure after brief exposure to a match (or other ignition source), although such materials might under more extreme conditions, such as when the oil is heated. Thus, for example, a fuel may have a flash point or a fire point of less than about 90° C., less than about 80° C., less than about 70° C., less than about 60° C., less than about 50° C., or less than about 40° C. in some cases, where the flash point is the lowest temperature at which the material will ignite or combust when exposed to an external ignition source, and the fire point is the lowest temperature at which the material will, after being initially ignited by an external ignition source, continue to burn or combust for at least 5 seconds after exposure and removal of the external ignition source.

Typically, the fuel is liquid and flows to conform to the outline of its container, although the fuel may be relatively viscous in some cases (i.e., having a viscosity that is greater than the viscosity of water). The fuel may also be viscoelastic and/or solid in some embodiments. Most, but not all, fuels are inedible, i.e., such fuels are not routinely eaten by people, and consumption of such fuels would result in adverse biological effects, including toxicity, poisoning, liver damage, organ failure, or death. The solid agent comprising MG and glycerine may be dispersed in the hydrophobic liquid in a number of different ways. For example, the agent may be added in solid form to the hydrophobic liquid at ambient temperature, which liquid may be agitated or shear-blended sufficiently for dispersal of the agent as microparticles comprising MG that has been hydrogen bonded with glycerine. In another embodiment, the agent comprising MG and glycerine is melted, added and dispersed in the hydrophobic liquid at a temperature below the precipitation temperature of the MG-glycerine complex to cause rapid precipitation of microparticulate solids or larger solid particles that subsequently disaggregate into microparticles. In yet another embodiment, the MG-glycerine agent is melted and added to warmed hydrophobic liquid that is at a temperature above the precipitation temperature of the agent in the hydrophobic liquid. In some cases, the result is that the agent is dissolved in hydrophobic liquid above the precipitation temperature. The agent may be precipitated in some embodiments by cooling, usually rapid cooling, for example by mixing the warmed liquid/agent mixture into a quantity of cooler hydrophobic liquid. This may be performed such that the combination has sufficient quantity and sufficiently cool temperatures so that the combination of the two results in a mixed liquid below the precipitation temperature of the agent.

The ability of various embodiments described herein, including but not limited to fuel compositions containing an agent composed predominantly of glyceryl monostearate and/or glyceryl monopalmitate and glycerine to thicken OMS fluid (and/or other liquids or liquid fuels, e.g., fatty acid alkyl ester fuels, mineral oils, etc.) may be useful in some cases to solve one or more problems associated with the prior use of some of these fluids for lighting fires, in certain aspects of the invention. OMS is a low viscosity petroleum liquid that tends to dribble from the aperture of a container and contaminate the outside of the container and one's hands. The compositions disclosed herein, at least in certain cases, has no tendency to dribble, e.g., due to their thickened state. In some embodiments, as outlined above, most of the monoglyceride-gelled or semi-gelled fluid may be retained as a visible coating, e.g., on the surface of the charcoal (or other solid fuel). This visual cue may be particularly obvious in embodiments where the thickener makes the fluid white and opaque, and this visual cue may be used to give a user an immediate indication of where and how much of the composition has been applied. In some cases, the applied fuel composition that is applied to the surface of charcoal briquettes (or other suitable solid fuel), for example, may be more easily ignited for an extended time interval (e.g., in contrast to traditional OMS fluids that have a tendency to disappear from the surface as it is absorbed therein). For example, one set of embodiments is generally directed to gelled compositions that melt at approximately 133° F. As a non-limiting example, the composition may include monoglyceride-thickened mineral spirits. As a newly ignited flame propagates over and through a group of charcoal briquettes (as an illustrative non-limiting example), the composition comprising the MG gel may melt, and the liquefied fuel may ignite while being absorbed into the surface of the charcoal, e.g., where it can burn and/or ignite nearby charcoal. Thus, the former problem of rapid and/or deep absorption of a traditional liquid lighter fluid such as OMS fluid into charcoal (making initial ignition difficult) can be avoided using certain embodiments of the invention, and/or a smaller quantity of the thickened fuel composition can be applied to the charcoal (and/or another suitable solid fuel), to allow for ignition of the surface.

In terms of the environment and air quality considerations, in some (but not all) embodiments of the invention, the fuel compositions consist essentially of carbon, hydrogen and oxygen atoms that, upon complete combustion, produce water and carbon dioxide. The fuel compositions, in some cases, are free of heavy metals and/or are free of chlorinated and other halogenated compounds that, upon burning, could produce dioxin and other toxic substances. The fuel compositions are expected to meet California and/or Federal Volatile Organic Compounds (VOC) emission standards for charcoal lighter material products in certain embodiments of the invention. Accordingly, the fuel compositions are able to, in some embodiments, produce no more than 0.020 pounds VOC per start according to the California South Coast Air Quality District Rule 1174 Ignition Method Compliance Certification Protocol, dated Feb. 27, 1991, or an equivalent amount under a subsequent Ignition Method Compliance Certification Protocol or alternate protocol. In some cases, the fuel compositions produce no more than 0.01 pounds, or no more than 0.005 pounds VOC per start under the cited protocol.

In some embodiments, during use of the fuel composition, and depending upon the amount of charcoal (and/or other solid fuel) being used, the amount of fuel composition required for lighting a fire may vary, e.g., between approximately 1 and 10 fluid ounces. In some cases, the amount of fuel composition applied to a solid fuel such as charcoal or fireplace wood will vary between 2 fluid ounces and 6 fluid ounces, or between 3 fluid ounces and 5 fluid ounces. In some cases, the quantity of fuel composition can vary between 2-16 fluid ounces, 4-10 fluid ounces, 4-12 fluid ounces, 6-12 fluid ounces, or 6-10 fluid ounces. In certain cases, the quantity of fuel composition is selected to provide at least 10 minutes, 15 minutes, or 20 minutes of burn time.

As indicated above, in some aspects of the present invention, Applicant has discovered that certain hydrophobic liquids such as hydrophobic liquid fuels can be thickened to produce a fuel composition using a remarkably low level, e.g., 2%-4% by weight, of an agent such as described herein, using a simple mechanical blending process for introducing the agent into the liquid, for example, a liquid fuel. In certain embodiments, agents that are predominantly SFA-MGs have been found quite effective. Agents containing primarily $C_{16}$ and/or $C_{18}$ fatty acid MGs can be advantageously used in some cases. For example, some agents that have proven to be quite effective are mixtures of $C_{16}$ and $C_{18}$ saturated fatty acid-containing distilled MGs (e.g., glyceryl monopalmitate and/or glyceryl monostearate) or mixed mono- and diglycerides, e.g., prepared from hydrogenated palm oil. With diglycerides as well as MGs, $C_{18:0}$ and/or $C_{16:0}$ saturated fatty acids may be used in some embodiments. Some of these are commercially available. In some cases, the glycerides prepared from fats whose fatty acid carbon chains are longer (e.g., $C_{16:0}$ and $C_{18:0}$) may have higher melting points than glycerides prepared from fats whose fatty acid carbon chains are shorter (e.g., $C_{12:0}$ and $C_{14:0}$) and/or unsaturated (e.g., oleic acid, $C_{18:1}$).

Some commercially-available preparations comprising diglycerides may contain glyceryl dipalmitate, glyceryl distearate and/or glyceryl palmitostearate. In the case of mineral spirits and paraffin oil-based fuels, a MG that contains low levels of diglycerides can be used in some embodiments as an effective thickening and gelling agent, often at a final concentration of approximately 3-5% by weight commingled with glycerine at final concentrations of approximately one-half of the glyceride concentrations, e.g., 1.5-2.5%. In other embodiments, however, other materials may also be present.

As a specific, non-limiting example, two parts by weight of a fully hydrogenated palm oil-derived MG (e.g., Myverol™ 18-04 from Kerry Ingredients and Flavors, Inc., Beloit, Wis.) containing approximately 95% by weight MGs, as essentially glyceryl monopalmitate and glyceryl monostearate, and having a melting point of 66° C., are conveniently melted and thoroughly admixed with 1 part by weight of glycerine to produce a complex in which approximately two glycerine molecules are hydrogen-bonded to each MG molecule. Between approximately 3% and 8% by weight of this complexed material may be usefully dispersed in a fuel composition such as OMS. Using a phase contrast microscope for visualization at 150-600× magnification, an immobilized array of very small amorphous particles having a diameter of less than 5 microns in diameter are observed. Most of the particles are 2-4 microns in diameter, 1-2 microns in diameter, and smaller. Dispersed in OMS fuel and viewed under the microscope, the particles appear to loosely bind to one another and are surprisingly effective in sequestering and thickening the fuel.

The fuel compositions described herein can be produced in a number of different methods, including industrial scale methods, in various embodiments of the invention. For example, a continuous-flow process suitable for commercial scale production of thickened lighter fluid may be used under some conditions.

In one embodiment, the complexed MG-glycerine thickening agent solids and a hydrophobic liquid fuel such as OMS may be separately fed, metered and brought together in a continuously fashion using a mixing chamber of sufficient but not excessive volume, fitted with an agitator that provides shear-blending of the ingredients. The temperature of mixing may be, for example, ambient temperature. As a non-limiting example, feeding of the thickening agent into a mixing chamber may be accomplished using an auger conveyor. The fluid stream of fuel or other hydrophobic liquid may be fed and metered into the same mixing chamber using a conventional liquid metering pump such as a piston pump.

Where a mixing chamber is used, the thickened OMS (or other liquid or liquid fuel as discussed herein) may be pumped or otherwise transported from the mixing chamber, for instance, to a holding tank or directly to a filling line where the product is packaged in consumer retail containers. The mixed fluid may be passed, for instance, through an intermediate mixing tank to ensure homogeneity, directed into a holding tank, or sent directly to a filling line.

For consumer convenience and ease of use, it is helpful to utilize an appropriately sized container (e.g., a 1 pint or a 1 quart or 2 quart capacity container) in various aspects of the invention. One example of a convenient container has sufficiently flexible walls and suitably configured and arranged dispensing hole(s) that allow the fuel composition to be dispensed by squeezing the walls of the container. For example, the fuel composition may be dispensed onto charcoal, a wood surface, or any other fuel described herein, e.g., solid fuels.

A number of thickening agents for hydrocarbon liquids are described, for example, by Cohen, et al. in U.S. Pat. No. 4,012,205. Soaps, waxes, various polymers, sterols and other agents such as fumed silica have been used as thickeners for hydrocarbon liquids. For military use, gasoline has been thickened and gelled by addition of benzene and polystyrene to form napalm B. However, when compared with the present use of MGs that are edible, environmentally sustainable, easy to use, and/or inexpensive, many of the previously described agents have the disadvantages of being either more difficult to utilize, more costly, or employ ingredients that produce greater pollution when burned in air.

While not wishing to be bound by theory, Applicant believes that in a hydrophobic liquid fuel environment substantially lacking in water, such as OMS or other liquid fuels described herein, groups of MG molecules (or similarly with diglycerides) may establish an atypical structural array of molecules when compared to their orientation in a classical emulsion. For example, with respect to MG molecules dispersed in an oil-in-water environment, e.g., mayonnaise or vinaigrette dressing, it is believed that the glyceryl hydroxyl groups normally face outward into the surrounding aqueous environment, and the fatty acid chains face inward on suspended oil microdroplets. However, with the present atypical arrangement, the hydroxyl groups and associated glycerine molecules on each MG molecule may form hydrogen bonding bridges linking together neighboring MG molecules in microparticles. This hydroxyl bridge configuration would allow the hydrophobic alkane-like fatty acid tails of the MG to extend into the surrounding hydrophobic fuel, enabling these tails to help stabilize this arrangement and thicken the fuel, e.g., alkane molecules.

Consistent with this proposed mechanism, while not being bound by theory, Applicant has observed that when concentrated MGs are predissolved in heated OMS (e.g., 40% by weight Myverol™ 18-04 dissolved in OMS at 70° C.) and then rapidly dispersed into cool OMS, the OMS solution immediately thickens with ultra-fine precipitated microparticles. However, when simple Myverol™ 18-04 is melted at 70° C. and then rapidly dispersed into cool OMS, large crystals of MG are precipitated that show little thickening ability. Applicant believes, without wishing to be bound by any theory, that MG molecules within groups of MGs or microparticles undergo inversion (with fatty acids facing outward)

when heated and dissolved in OMS solvent, and maintain this orientation that provides thickening when precipitated. On the other hand, Applicant believes that when pure MGs are heated, melted and then rapidly precipitated while being dispersed in cool OMS, the groups of molecules are unable to flip their original molecular orientation (fatty acids facing inward) and are therefore unable to efficiently thicken a hydrophobic liquid such as OMS. It is also believed that a similar mechanism would be present with other agents discussed herein, e.g., with respect to diglycerides, fatty acids, etc.

In one non-limiting example, two burn tests were conducted using OMS (Kingsford Products) that had been thickened according to the dispersal methods described herein. More specifically, 6% by weight of solid thickening agent consisting of 2 parts Myverol™ 18-04 MG melted and combined with 1 part glycerine (w/w) was dispersed by shear-blending at ambient temperature in OMS fuel. This yielded a final concentration of 4% (w/w) of MG in the OMS fuel composition. Alternatively, Applicant's previous dispersal method was used according to co-pending U.S. patent application Ser. No. 13/205,026, incorporated herein by reference. In that earlier method, a 40% by weight solution of Myverol™ 18-04 dissolved in OMS at approximately 65° C. to 75° C. was diluted 10-fold with high speed dispersal into OMS at 20° C. to obtain a final concentration of 4% (w/w) MG in the OMS composition. As shown here, both of these OMS compositions may be useful preparations for a commercial charcoal lighter consumer product. A 4 lb. quantity of Kingsford charcoal was ignited (80 briquettes, average weight of 22.5 g each) as follows:

Forty briquettes (900 g=2.0 lbs.) were laid flat and arranged close to one another in a circle on the charcoal support grate of a Weber kettle style charcoal grill (Weber-Stephen Products Co., Palatine, Ill.), forming a first lower layer of charcoal. Each OMS composition (2.5-3.0 g per briquette) was then applied to the upper surface of the briquettes in this lower layer (100-120 g thickened OMS, fluid density 0.8 g/cc, 125-150 cc total volume=4-5 fluid oz).

Each OMS composition described above remained immobile and was only minimally absorbed into the surface of these briquettes. A second upper layer of 40 briquettes was added and arranged on top of the first layer. In one test, the upper layer of briquettes was oriented flat, and in the second test the briquettes were oriented more or less on edge (i.e., the briquettes' perimeter edge was vertically oriented). No OMS composition was added to this second upper layer of charcoal, so the upper layer remains uncoated. (Contact and transfer of some thickened fluid through contact between the upper and lower layers is not considered coating, and therefore the upper layer remains uncoated following such contact and transfer.) This "edge-up" second layer arrangement provided greater air space among the briquettes for increased air circulation during combustion. Remarkably, in all burn tests, within 10-13 minutes after igniting the OMS composition (placed only on the lower layer of briquettes), essentially all of the briquettes were at least 50% ash-covered and ready for grilling food. No residual odor of mineral spirits was detected.

When compared with unthickened conventional OMS fluid, the OMS compositions of this particular example can advantageously remain substantially non-absorbed on the surface of the charcoal or other solid fuel. This condition allows ample time for adding and arranging the above-described upper layer of charcoal on top of the first lower layer of charcoal coated with the OMS composition. Other features and advantages present in some embodiments of the invention are as follows: Upon lighting the fuel composition at any point on the bottom layer of charcoal, the fire spread through the entire bed of charcoal. Charcoal briquettes are rapidly and easily ignited using the above-described two layer geometry because heat is beneficially generated and sustained between the lower and upper layers of charcoal.

Further, because flame and heat generated from combustion in the lower layer rises to the upper layer of charcoal briquettes, the entire charcoal lighting process occurred in this particular non-limiting example more efficiently and rapidly. The 10-13 minute interval between igniting the thickened OMS fuel and the charcoal being ready for grilling food is approximately one-half the normal time required for lighting charcoal by the conventional method (e.g., spraying unthickened OMS over a compact pre-formed mound of charcoal).

By comparison, when a conventional low viscosity OMS liquid is used according to directions, and is spray-applied/squirted onto a mound of charcoal lumps or briquettes, very little of the total flame is being generated below the surface of the charcoal mound. Consequently, very little of the charcoal mass is being contacted or heated by the hotter portions of the flames, and charcoal lighting is slow and inefficient, typically requiring 30 minutes or more.

Based on the above example, Applicant also wished to determine whether the use of unmodified fluid OMS could be improved using a method of applying and burning the fuel similar to the new method described above. Accordingly, Applicant repeated the above-described method for igniting two layers of charcoal briquettes, in which the lower layer was soaked with unmodified OMS lighter fluid and the upper layer was not. To the best of Applicant's knowledge, selective application of lighter fluid to a lower layer of charcoal rather than to the upper outer layer runs contrary to commercial instructions. In fact, typical commercial instructions provided with OMS-type charcoal lighter fluids consistently teach the following (paraphrased from several commercial products):

> Lighting instructions: Arrange charcoal briquettes in a pile or pyramid. Apply starter fluid over the pile of charcoal, use 1.6 fluid ounces (47 milliliters) per pound of charcoal. Light the charcoal immediately. The starter fluid will burn off cleanly in a few minutes leaving the charcoal fully ignited. When briquettes ash over, spread them out evenly and begin barbecuing.

In this example, and contrary to these instructions, forty closely spaced briquettes were laid flat and centered on a charcoal support grate of a Weber kettle style charcoal grill to form a lower layer of charcoal. The exposed upper surfaces of these briquettes were soaked with regular OMS fluid (2.5-3.0 g of OMS applied to the top of each briquette). Forty additional briquettes (without OMS) were placed on top of the OMS-treated briquettes to form an upper layer of charcoal. Most of the briquettes in this upper layer were arranged with their edges angled upward to provide air space/ventilation between neighboring briquettes. Approximately 3-4 minutes intervened between the time OMS was added to the lower layer of briquettes and the time of igniting the charcoal, during which the uncoated briquettes were placed on top of the OMS-soaked briquettes. Upon lighting the briquettes the flames soon propagated across the entire bed of charcoal.

Surprisingly, within ten minutes, approximately 75% of the surface area of the briquettes was ash-covered and the charcoal was ready for grilling food. This time between lighting the fire and the charcoal being ready for grilling was similar to the time measured using the Myverol-thickened OMS. This two-layer method in which only the lower (bottom) layer of charcoal receives lighter fluid appears to be effective in minimizing the time between igniting the charcoal lighter and grilling food. The single upper layer of charcoal briquettes is also effective in capturing much of the heat generated from the lower layer while still allowing enough air ventilation to support combustion. Thus, this method is a useful method for achieving rapid lighting of charcoal. Moreover, this method is not limited to only OMS, but can be used for any other suitable fuel composition for lighting charcoal briquettes, or other solid fuels such as those discussed herein, including thickened or unthickened fuel compositions.

While the tests above focused on the use of OMS, other hydrophobic fuels can also be used in a similar manner, in other embodiments of the present invention. Thus, for example, in another embodiment, a thickened hydrophobic biofuel composition was produced using a monomethyl ester fatty acid liquid fuel (methyl decanoate, CAS Reg. No. 110-42-9, product designation CE-1095, P&G Chemicals, Inc., Cincinnati, Ohio). This fuel composition was modified by adding and thermo-precipitating a mixture of SFA-MGs (Myverol™ 18-04, described above) and a palm stearin triglyceride (Revel A stearin, Loders Croklaan Inc., Channahon, Ill.). These ingredients were initially heat-solubilized at approximately 70° C. in the CE-1095 liquid as a five-fold concentrate containing approximately 20% by weight Myverol™ 18-04 and approximately 12% Revel A.

This heated concentrate was then diluted five-fold while being rapidly mixed with CE-1095 provided at ambient temperature to produce a final mixing temperature of 30° C. The rapid mixing and accompanying rapid drop in temperature may favor formation of small crystals. As a specific non-limiting example, the final concentration of MG at approximately 4% by weight and the stearin concentration at approximately 2.4% by weight may be used to produce a thick liquid that can remain stationary as a coating, or can flow slowly under mild pressure. The resulting fuel composition may, for example, be readily applied and/or be allowed to remain immobilized on a solid fuel, e.g., charcoal or fireplace wood.

Any suitable concentration of MG and/or other e.g., diglycerides, fatty acids, etc. can be used. In one set of embodiments, Myverol™ 18-04 MG concentrations added to fatty acid ester biofuels was between 2% and 8% by weight, while the stearin triglyceride range was between 1% and 4% by weight. Remarkably, the combined use (and possible co-crystallization) of MGs with stearin triglycerides may be used in certain fuel compositions discussed herein, e.g., for monoalkyl ester fatty acid biofuels. However, in other embodiments, the crystallization of MGs alone may also be used for certain fuel compositions described herein, e.g., as described herein.

As another particular, non-limiting example, to test the efficacy of the fuel composition described above, four pounds of charcoal briquettes were ignited with this fuel using the same procedure described above for the OMS composition. Again, forty briquettes weighing 2.0 lbs. were placed flat and close together on the charcoal support grate to form a first lower layer of charcoal, and thickened CE-1095 fluid containing 4% by weight Myverol™ 18-04+2.4% by weight Revel A (2.5 g per briquette) was applied to the upper surface of the briquettes in this lower layer (100 g total thickened fluid). A second upper layer of 40 briquettes was added and arranged flat on top of the first layer without adding any more CE-1095 fuel. Within 12 minutes after igniting the fuel on the lower layer of charcoal, most of the briquettes were at least 50% ash-covered and ready for grilling food. No residual odor was detected.

In one set of embodiments, purified glycerine and/or purified saturated fatty acid monoglycerides may be used, although in other embodiments, the glycerine and/or the saturated fatty acid monoglyceride need not be purified. The term "purified" used in conjunction with "saturated fatty acid monoglycerides" or SFA-MGs refers to at least one MG agent or substance that has been separated, fractionated, distilled and/or otherwise refined to be substantially free of contaminating chemical and physical substances that interfere with use of these MGs in forming the novel complexes described herein. In this regard, the presence of fatty acid diglyceride substances mixed with fatty acid MGs are not considered contaminating substances. Generally, a "purified" substance should contain less than 10% by weight of contaminating substances, or less than 5%, 2% or even less than 1% by weight of contaminating substances. Likewise, "purified glycerine" refers to glycerine than is substantially free of contaminating chemical and physical substances that could likewise interfere with the use of glycerine in forming the novel complexes described herein. Purified glycerine should contain less than 10% by weight of contaminating substances, or less than 5%, 2% or even less than 1% by weight of contaminating substances.

The term "substantially water-free" or in the "substantial absence of water" are terms describing mixtures or blends in which at least one purified MG agent and purified glycerine are heated, melted, mixed and cooled together to form a hydrogen-bonded complex, in which any substantial concentration of water can compete, interfere, or block glycerine molecules from forming hydrogen-bonds with the MG molecule. Accordingly, it is preferable that no measurable levels of water are present in the mixture, and that in any event the molar ratio of glycerine molecules to water molecules in the heated mixture should be at least 10:1 and preferably 25:1, 50:1 or 100:1 or even greater.

The term "substantially pure solid" or "purified solid" relates to solid products formed by combining at least one purified SFA-MG and purified glycerine in a mixture that is melted (optionally such that its molecules are able to commingle), cooled and solidified, in which the resulting solids include a hydrogen-bonded $G_2MG$ molecular complex consisting of two molecules of G hydrogen-bonded to each molecule of MG. The term "substantially pure" in this regard means that the solids contain less than 10% by weight of contaminating substances, or less than 5%, 2%, or even less than 1% by weight of contaminating substances that could interfere with the thickening of a hydrophobic liquid by the solids.

A number of contaminating substances may interfere with the stability and use of the present MG agent (or combined MG and diglyceride agent) to thicken a hydrophobic liquid, and may be removed in the process of purification of these agents, at least in certain cases. As a non-limiting example, when a MG or MG+diglyceride agent is a product of an interesterification reaction and may contain, as contaminants, fatty acids, sodium hydroxide or lipases that hydrolyze and/or interesterify fatty acids with glycerides, these substances can continue to be chemically reactive and can destabilize or interfere with the use of these solids as a thickening agent. Thus, these contaminating substances may be partially or completely removed during purification in some embodiments of the invention.

The term "fuel," "liquid fuel" or "fuel composition" refers to a composition that is freely combustible in air once ignited by a flame source. Furthermore, in some cases, prior to modifying, e.g., by addition of a thickening agent, the fuel may be liquid at room temperature and 1 atmosphere, and can be poured and/or pumped. After thickening, the fuel composition can at least partially liquefy during combustion.

The terms "combustible," "hydrocarbon," "aliphatic," "fatty acid," "alkyl ester," have conventional definitions. Thus, for example, a ten carbon fatty acid with an ester-linked methyl group is a decanoate methyl ester (or methyl decanoate which is a mono-alkyl ester fuel), while odorless mineral spirits (OMS) is an aliphatic hydrocarbon fuel. Both of these example fuels are highly combustible and accordingly ignite by flame contact.

The term "hydrophobic liquid" generally refers to a non-aqueous liquid. The liquid may, in some embodiments, be a substance that is liquid at room temperature and 1 atmosphere, and that is immiscible with water, i.e., at least a portion of the liquid phase-separates when exposed to water under these conditions. Examples of hydrophobic liquids include, but are not limited to, alkyd paints and other petroleum solvent-based coatings, fatty acid ester liquids such as methyl esters of $C_8$, $C_{10}$, and $C_{16}$, or $C_{18}$ fatty acids (e.g., commonly used in consumer products or fuels, e.g., stearic acid).

The term "saturated fatty acid monoglyceride" or SFA-MG refers to a glycerol molecule in which the hydroxyl group on any one or more of the three carbon atoms has been replaced an ester-linked saturated fatty acid such as palmitic acid ($C_{16:0}$) or stearic acid ($C_{18:0}$).

The term "thermo-precipitated" as it relates to a fuel composition refers to an agent such as a MG in which the physical state of the agent is altered from soluble to insoluble via a decrease in the temperature of the fuel. For example, in the context of MG precipitation and thickening fuels described in Applicant's co-pending U.S. patent application Ser. No. 13/205,026, incorporated herein by reference, a rapid temperature decrease can be used under certain conditions to induce rapid precipitation of a MG, that can be used to thicken a fuel. The MG may be easily heated (e.g., to 70° C.) and/or dissolved in a portion, e.g., at least a small portion, e.g., 10% by weight, of the hydrophobic liquid used in the fuel composition. The heated and dissolved MG may be rapidly blended, dispersed, and/or cooled with the remaining bulk, e.g., 90% by weight, of the hydrophobic liquid retained at room temperature, which may result in thickening of the fuel composition. It should be recognized the monoglyceride agent or MG may precipitate in some embodiments over a temperature range rather than at one specific temperature. In some cases, rapid cooling may assist in precipitating multiple components in a MG agent together.

As used herein, terms such as "saturated fatty acid monoglyceride" (SFA-MG), "saturated monoglyceride" and "monoglyceride" (MG) are all used to refer to molecules in which one saturated fatty acid is chemically ester-linked to one of the glycerol moiety's carbon atoms Similarly, the terms "disaturated diglycerides" and "tri-saturated triglycerides" refer to glycerol molecules in which, respectively, either two or three saturated fatty acid molecules are chemically ester-linked to either two or three of the glycerol's carbon atoms. An agent may include, for example, MGs, diglycerides, and/or triglycerides, and/or other components as those discussed herein.

The term "saturated fatty acid monoglyceride agent" (SFA-MG agent) and similar terms referring to agents used in various embodiments generally refers to a preparation or set of preparations which are combined in the hydrophobic fuel. The agent may contain, for example, SFA-MGs, and/or di- and/or tri-glycerides. Other components may also be present in the agent. In some embodiments, a variety of components may be present within the agent that do not excessively interfere with the thickening function of the agent. In some cases in which the agent comprises multiple components, the various components may be combined, e.g., prior to adding and/or thermo-precipitating the agent in the hydrophobic liquid. However, this is not essential; in other cases, for example, different components may be added separately to form a solution with a portion of the hydrophobic liquid, and/or may be added to separate portions of hydrophobic liquid to form separate solutions, each of which may be added to and thermo-precipitated in the cool hydrophobic liquid. The portions may be small in some cases. In cases where multiple agent component solutions are added to the cool hydrophobic liquid, in some embodiments, the additions are essentially simultaneous.

As used in connection with the present combustible hydrophobic liquids, the terms "thickened" and "thickening" refer to a significant increase in viscosity. For example, the viscosity may be increased such that the thickened liquid does not flow as a thin liquid at 20° C. The thickening may, for example, result in a fuel having a "syrupy" degree of viscosity or may be thicker, e.g., substantially or fully gelled at 20° C. In this context, "gelled" means the thickened material does not appreciably flow when a 2 cm cube is placed on a horizontal surface for 5 minutes at 20° C.

The terms "portion," "smaller portion," and "larger portion" as these terms are used herein, are meant to describe amounts and relative amounts by weight of fuel. More specifically, the term "portion" includes any suitable percentage, including both "small portions" (as little as 1% of an entire amount) and large portions (as much as 100% of an amount). A "larger portion" is defined as being at least two-fold greater in weight than a "small portion" or a "smaller portion." A "larger portion" may also be much greater than two-fold greater than the "smaller portion," e.g., it may be ten-fold greater, 20-fold greater or even more. Thus, a smaller portion of one part by weight of a fuel composition containing 60% by weight of dissolved MGs may be diluted by combining with a 19-fold larger portion of cool fuel to produce 20 parts by weight of a combined fuel mixture containing 3% by weight of precipitated MGs that thicken the fuel composition.

The term "ambient temperature" refers to the air temperature in the manufacturing facility that typically ranges from approximately 20° C. to 25° C.

The terms "unheated" and "essentially unheated" are used to describe liquid fuel that is being combined with a heated MG-containing fuel (the latter being typically heated to a temperature of greater than 60° C.). The terms refer to liquid fuel that is substantially cooler than the heated fuel. More specifically, these terms are meant to include a broad range of cooler temperatures ranging from refrigerated temperatures (that may be as low as 0° C.) to temperatures as high as 40° C. For reasons of economy and energy conservation, unheated and essentially unheated temperatures are often at ambient temperatures, typically in the range of 20-25° C.

As used in connection with this invention, the term "charcoal" refers to charcoal in relatively large chunks, e.g., either or both irregular or unshaped lump charcoal and shaped briquette-style charcoal. Unless unshaped lump charcoal is specifically excluded, use of the term "charcoal briquettes" may include both shaped briquettes and the unshaped lump charcoal. Similarly, unless shaped briquette charcoal is specifically excluded, use of the term "lump charcoal" includes both shaped briquettes and the unshaped lump charcoal.

The term "ash-covered" refers to a bed of charcoal whose exposed surface is at least 50% covered with ash produced by the ignited surface.

The phrase and terms contained herein for methods of lighting charcoal describe "applying the fuel composition to a first lower layer of charcoal resting on a non-combustible support grate in a barbecue grill." This phrase refers to either a thickened or unthickened hydrocarbon or alkyl ester-based hydrophobic fuel that is sprayed or otherwise dispensed onto the exposed upward-facing surfaces of a layer of charcoal briquettes or lumps placed side-by-side on a typical metal grate that supports charcoal in a grill. This initial layer of charcoal constituting the so-called "first lower layer" is distinguished from the "second upper layer" of charcoal (in most cases an amount roughly similar to the first lower layer). The second upper layer is placed on top of the first lower layer, and does not necessarily require addition of any more lighter fuel. The charcoal "support grate" must allow ample air circulation around the charcoal to support combustion.

The phrase and terms contained herein for methods of lighting charcoal describe "lighting charcoal and reducing the time required for the charcoal to become ash-covered and ready for grilling food." The prior art methods that utilize conventional OMS lighter fluid that is applied to the outer surface of a typical 4 pound mound of charcoal require at least 20 minutes combustion time for the charcoal to become ash-covered and ready for grilling food.

One skilled in the art would readily appreciate that various embodiments of the present invention are well adapted to obtain the ends and advantages mentioned, as well as those inherent therein. The methods, variances, and compositions described herein as presently representative of embodiments herein are exemplary and are not intended as limitations on the scope of the invention. Changes therein and other uses will occur to those skilled in the art, which are encompassed within the spirit of the invention, are defined by the scope of the claims.

It will be readily apparent to one skilled in the art that varying substitutions and modifications may be made to the inventions disclosed herein without departing from their scope and spirit. For example, variations can be made in the particular choice of MG(s) in the claimed composition, source and selection of other thickening or crystallization stabilizing agents such as stearin triglycerides that may be combined with MGs, method of combining and/or diluting ingredients in the claimed composition and the like. Furthermore, it will be recognized that other components may be added to the fuel compositions for particular applications. For example, masking fragrances that alter the overall odor of the fuel compositions may be advantageously added to the above-described compositions. Such additions and variations are within various embodiments of the present invention. Thus, such additional embodiments are within the scope of the present invention and the following claims. It will be readily apparent to one skilled in the art that varying substitutions and modifications may be made to the inventions disclosed herein without departing from their scope and spirit.

The inventions illustratively described herein suitably may be practiced, in some embodiments, in the absence of any element or elements, limitation or limitations that are not specifically disclosed herein. Thus, for example, in each instance herein any of the terms "comprising," "consisting essentially of" and "consisting of" may be replaced with either of the other two terms. The terms and expressions which have been employed are used as terms of description and not of limitation, and there is no intention that in the use of such terms and expressions of excluding any equivalents of the features shown and described or portions thereof, but it is recognized that various modifications are possible within the scope of the inventions claimed. Thus, it should be understood that although the present inventions have been specifically disclosed by preferred embodiments and optional features, modification and variation of the concepts herein disclosed may be resorted to by those skilled in the art, and that such modifications and variations are considered to be within the scope of this invention as defined by the appended claims.

In addition, where features or aspects of the invention are described in terms of Markush groups or other grouping of alternatives, those skilled in the art will recognize that in other embodiments, the invention may be described in terms of any individual member or subgroup of members of the Markush group or other group.

Also, unless indicated to the contrary, where various numerical values or value range endpoints are provided for embodiments, additional embodiments are described by taking any 2 different values as the endpoints of a range or by taking two different range endpoints from specified ranges as the endpoints of an additional range. Such ranges are also within the scope of the described inventions. Further, specification of a numerical range including values greater than one includes specific description of each integer value within that range.

Thus, additional embodiments are within the scope of the described inventions and within the following claims.

What is claimed is:

1. A composition comprising:

at least one hydrophobic liquid or liquid fuel; and a mixture of at least one purified saturated fatty acid monoglyceride (abbreviated "SFA-MG") and purified glycerine (abbreviated "G"), wherein the molar ratio of G to SFA-MG in said mixture is between approximately 1:1 and approximately 4:1; and wherein the composition is fluid at ambient temperature.

2. The composition of claim 1, wherein said SFA-MG and said G, as purified ingredients in said composition, are substantially free of contaminating reactants, catalysts, alkaline agents and by-products of interesterification that interfere with the use of said composition as a thickening agent.

3. The composition of claim 2, wherein said contaminating reactants, catalysts, alkaline agents and by-products are selected from the group consisting of free fatty acids, interesterifying enzymes, sodium hydroxide, fats and combinations thereof.

4. The composition of claim 1, wherein said SFA-MG comprises a fatty acid moiety selected from the group consisting of lauric acid, myristic acid, palmitic acid, stearic acid and combinations thereof.

5. The composition of claim 1, wherein said SFA-MG comprises a fatty acid moiety selected from the group consisting of palmitic acid, stearic acid and combinations thereof, wherein the composition contains a molar ratio of approximately 2 moles of G to 1 mole of SFA-MG.

6. The composition of claim 1, wherein said composition comprises microparticles, and said microparticles are dispersible in a hydrophobic liquid at ambient temperature to cause thickening of said hydrophobic liquid.

7. The composition of claim 6, wherein the average diameter of said microparticles is less than 5 microns.

8. The composition of claim 6, wherein said hydrophobic liquid or liquid fuel is a hydrocarbon-based or fatty acid ester-based hydrophobic liquid.

9. The composition of claim 6, comprising between 1% and 10% by weight of said microparticles.

10. The composition of claim 6, wherein said hydrophobic liquid comprises an aliphatic hydrocarbon liquid.

11. The composition of claim 10, wherein said aliphatic hydrocarbon liquid is selected from the group consisting of odorless mineral spirits and paraffin oils.

12. The composition of claim 6, wherein said hydrophobic liquid comprises a fatty acid alkyl ester liquid.

13. The composition of claim 6, wherein the composition comprises solids, wherein at least 50% by weight of said solids are composed of said microparticles.

14. The composition of claim 1, wherein at least 50% by weight of said SFA-MG comprises glyceryl monostearate or glyceryl monopalmitate, or a mixture of glyceryl monostearate and glyceryl monopalmitate.

15. The composition of claim 1, further comprising between 1% and 50% by weight of at least one saturated fatty acid diglyceride agent.

16. The composition of claim 1, further comprising between 1% and 50% by weight of fat.

17. The composition of claim 1, wherein said mixture is a solid mixture at room temperature.

18. The composition of claim 17, wherein the solid mixture is a particulate solid mixture.

19. A method of thickening a hydrophobic liquid or a liquid fuel comprising:

dispersing between 1% and 10% by weight of the microparticles of claim 6 in said hydrophobic liquid or liquid fuel using shear-blending; wherein the resulting thickened hydrophobic liquid or liquid fuel is fluid at ambient temperature.

* * * * *